US007980835B2

(12) United States Patent
LaBanco et al.

(10) Patent No.: US 7,980,835 B2
(45) Date of Patent: Jul. 19, 2011

(54) TUBE RETAINER SYSTEM FOR A PERISTALTIC PUMP

(75) Inventors: Sam LaBanco, Northbrook, IL (US); Michael Reedy, Chicago, IL (US)

(73) Assignee: Cole-Parmer Instrument Company, Vernon Hills, IL (US)

( * ) Notice: Subject to any disclaimer, the term of this patent is extended or adjusted under 35 U.S.C. 154(b) by 334 days.

(21) Appl. No.: 11/624,852

(22) Filed: Jan. 19, 2007

(65) Prior Publication Data

US 2008/0175734 A1 Jul. 24, 2008

(51) Int. Cl.
*F04B 45/08* (2006.01)
*F04B 43/12* (2006.01)

(52) U.S. Cl. ..... 417/477.12

(58) Field of Classification Search ..... 417/476, 417/477.1, 477.12, 477.3, 477.2, 477.4, 477.5, 417/477.6, 477.7, 477.8, 477.9, 477.11, 477.13, 417/477.14

See application file for complete search history.

(56) References Cited

U.S. PATENT DOCUMENTS

| | | | | |
|---|---|---|---|---|
| RE27,376 | E * | 5/1972 | Pickup | 417/477.12 |
| D229,560 | S | 12/1973 | Burke et al. | |
| 4,138,205 | A | 2/1979 | Wallach | |
| 4,193,398 | A | 3/1980 | Refson | |
| D264,134 | S | 4/1982 | Xanthopoulos | |
| 4,434,963 | A * | 3/1984 | Russell | 251/7 |
| 4,540,351 | A | 9/1985 | Olson | |
| 4,558,996 | A | 12/1985 | Becker | |
| D283,441 | S | 4/1986 | Vcelka et al. | |
| 4,631,008 | A | 12/1986 | Stenner | |
| D289,689 | S | 5/1987 | Becsi et al. | |
| 4,813,855 | A | 3/1989 | Leveen et al. | |
| 4,925,376 | A | 5/1990 | Kahler | |
| 4,976,590 | A | 12/1990 | Baldwin | |
| 5,082,429 | A | 1/1992 | Soderquist et al. | |
| 5,388,972 | A | 2/1995 | Calhoun et al. | |
| 5,433,588 | A | 7/1995 | Monk et al. | |
| 5,752,813 | A | 5/1998 | Tyner et al. | |
| 5,964,583 | A | 10/1999 | Danby | |
| 6,019,582 | A | 2/2000 | Green | |

(Continued)

FOREIGN PATENT DOCUMENTS

EP 0019205 A1 11/1980

(Continued)

OTHER PUBLICATIONS

Watson-Marlow Bredel Pumps, Watson-Marlow 300 Series Pumps, Powerful performance from the great new 323, [on-line], [retrieved on Nov. 17, 2005] Retrieved from Watson-Marlow Website using Internet http://www.watson-marlow.com/watson-marlow/p-300san.htm (1 page).

(Continued)

*Primary Examiner* — Devon C Kramer
*Assistant Examiner* — Bryan Lettman
(74) *Attorney, Agent, or Firm* — Wood, Herron & Evans, LLP

(57) ABSTRACT

A retaining assembly comprising a base and a retainer comprising a wall and a notch in the wall. The notch in the wall has an arcuate first portion and an arcuate second portion that converge at a juncture. The first and second arcuate portions of the notch are oriented toward the base and the retainer is slidably translatable from a first open position to a second closed position with the base.

19 Claims, 3 Drawing Sheets

U.S. PATENT DOCUMENTS

| | | | | |
|---|---|---|---|---|
| 6,494,692 | B1 | 12/2002 | Green | |
| D477,867 | S | 7/2003 | O'Mahony et al. | |
| 6,901,716 | B1 * | 6/2005 | Julian et al. | 52/712 |
| 7,214,038 | B2 | 5/2007 | Saxer et al. | |
| 2005/0126403 | A1 * | 6/2005 | Arias Lopez | 99/494 |
| 2005/0196307 | A1 | 9/2005 | Limoges | |

FOREIGN PATENT DOCUMENTS

| | | | |
|---|---|---|---|
| EP | 0731275 | A1 | 9/1996 |
| EP | 0825345 | A2 | 2/1998 |
| EP | 0834653 | A2 | 4/1998 |
| EP | 0 869 283 | A1 | 10/1998 |
| EP | 1048848 | A1 | 11/2000 |
| EP | 1291027 | A1 | 3/2003 |
| GB | 1 510 976 | A | 5/1978 |
| WO | 2004057190 | A1 | 7/2004 |

OTHER PUBLICATIONS

European Patent Office, European Search Report, European Patent Application No. EP08250136, dated Apr. 7, 2008, 6 pages.

* cited by examiner

TUBE RETAINER SYSTEM FOR A PERISTALTIC PUMP

FIELD OF THE INVENTION

The present invention relates generally to peristaltic pumps and, more particularly, to a tube retaining system for retaining a fluid carrying tube in a peristaltic pump.

BACKGROUND OF THE INVENTION

Rotary peristaltic pumps are typically used for moving liquids through flexible tubing. A typical peristaltic pump has a rotor assembly with pinch rollers that apply pressure to the flexible tubing at spaced locations to provide a squeezing action on the tubing against an occlusion bed. The occlusion of the tubing creates increased pressure ahead of the squeezed area and reduced pressure behind that area, thereby forcing a liquid through the tubing as the rotor assembly moves the pinch rollers along the tubing.

The spacing between the occlusion bed and the pinch rollers of the rotor assembly is critical for proper pump operation. The spacing between the occlusion bed and the pinch rollers is unforgiving from a tolerance standpoint since it is used both to provide a compressive force between the rotor assembly and occlusion bed and to locate the occlusion bed with respect to the rotor assembly. Tubing that is too loose in the pump may lead to flapping while tubing that is too tight may lead to excessive wear on the tubing. Improper installation of the tube may lead to poor pump performance and shortened tube life.

A typical peristaltic pump 10 is shown in FIG. 1. Stop tubing 12 is typically required in this type of pump in order to assure the proper length of tubing and tube tensioning inside the pump. Tube stops 14*a*, 14*b* are additional retainers that must be assembled onto the tubing at precise intervals that are dictated by the particular pump design. The predetermined distance in between the tube stops 14*a*, 14*b* establishes the proper length of tubing within the pump. A problem with tube stops 14*a*, 14*b* is that they require users of the pumps to order specialty products. The requirement of the tube stops 14*a*, 14*b* is an additional expense that occurs every time tubing 12 is replaced. The added expense is a result of extra parts (stops) and the labor required to precisely install the stops for the particular pump design. Outside of this particular pumping application, the "stop tubing" has no other use.

Other pumps may use retaining systems with retainers having v-shaped notches to hold the tubing, instead of using tube stops, such as the pump disclosed in U.S. Patent Application Publication 2005/0196307 A1, which is incorporated herein by reference in its entirety. These pumps are an improvement over those that require tubing with tube stops as the v-shaped notched clips serve to hold the tubing in place, eliminating the need and added expense of the tube stops. The v-shaped notches work well for a multitude of different tubing sizes and materials. Improvements may be made, however, to the notched retainers that would assist in avoiding any undesired results for large diameter tubing or low durometer tubing materials.

Accordingly, there is a need for a tube retaining system that provides the ability to retain automatically a wide range of tubing diameters and durometers, and provides consistent tube tensioning independent of the type of tube used.

SUMMARY OF THE INVENTION

The present invention overcomes the foregoing and other shortcomings and drawbacks of tube retainer systems heretofore known. While the invention will be described in connection with certain embodiments, it will be understood that the invention is not limited to these embodiments. On the contrary, the invention includes all alternatives, modifications and equivalents as may be included within the spirit and scope of the present invention.

The invention addresses these and other problems associated with known peristaltic pumps by providing a tube retaining system that eliminates the need for "stop" tubing by providing a retaining assembly having a base and a retainer. In one embodiment, the base has a generally planar tube engaging surface. The retainer has a wall with notch that is formed by an arcuate first portion and an arcuate second portion that converge at a juncture. The first and second arcuate portions of the notch are oriented toward the base and the retainer is slidably translatable from a first open position to a second closed position with the base so that the tube is retained between the retainer and the base.

According to one aspect of the invention, the lengths of the arcuate portions forming the notch in the wall may differ in length where the length of the arcuate first portion is greater than the length of the arcuate second portion. The first and second arcuate portions forming the notch in the wall of the retainer may be convex and the juncture of the two arcuate portions of the notch in the wall of the retainer may be arcuate.

According to another aspect of the invention, the retainer of the retaining assembly may be spring biased toward the closed position. When flexible tubing is positioned between the base and the retainer, the flexible tubing contacts the generally planar surface of the base and the top surface of the wall of the retainer and is held in place by the force exerted by the spring bias on the retainer.

Other advantages of the invention may include automatically retaining tubing in a peristaltic pumping application; being able to retain a wide range of tubing diameters using the same retention system; elimination of specialty tubing required for retention purposed; and lower tubing costs due to the elimination of the tubing stops.

These and other objects and advantages of the present invention will be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE PREFERRED EMBODIMENTS

Figure 1:
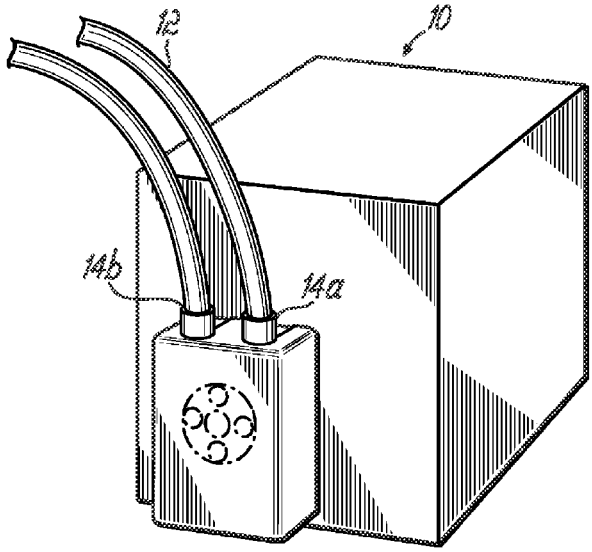
FIG. 1 PRIOR ART
FIG. 1 is a front perspective view of an exemplary peristaltic pump utilizing stop tubing.
Figure 1A:
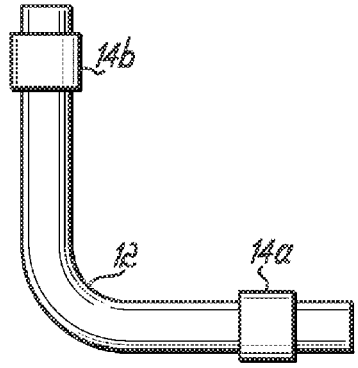
FIG. 1A PRIOR ART
FIG. 1A shows exemplary tubing containing stops for use with the pump in FIG. 1.
Figure 2:
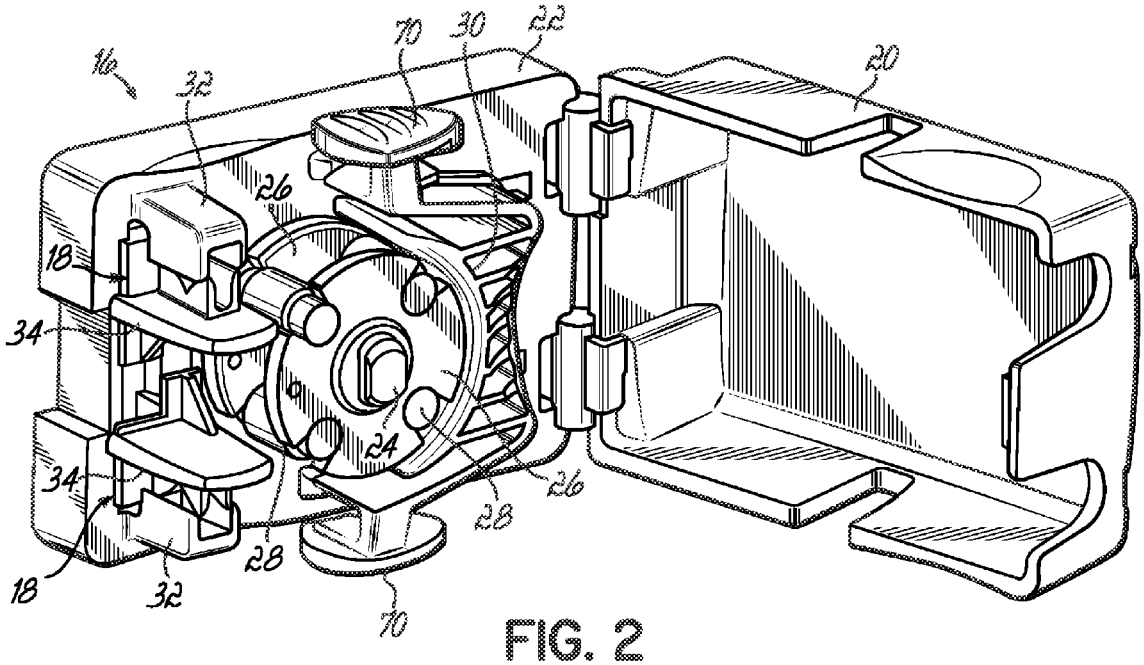
FIG. 2 is a perspective view of an exemplary peristaltic pump utilizing the tube retainer system of the present invention.

Referring now to the figures, wherein like numbers denote like parts throughout the several views, FIG. 2 illustrates an exemplary peristaltic pump 16 having a pair of tube retainer systems 18 in accordance with one embodiment of the present invention.

The exemplary pump 16 has a cover 20 attached to a body 22. A rotor assembly with a shaft 24, two plates 26, and several rollers 28 are also attached to the body 22. The plates 26 are fixed to the shaft 24, generally perpendicular to the axis of the shaft 24. The rollers 28 are secured, by means of respective axles, between the two plates 26. The rollers 28, being nearly identical in diameter, are situated at essentially the same radial distance from and equally spaced angularly about the rotor shaft axis. In turn, the shaft 24 is connected to a motor (not shown) that applies a rotational force to the shaft. Thus, when power is applied to the motor; the shaft rotates, causing the rollers 28 to describe an orbital path.

An occlusion bed 30 has a larger radius than the orbital path of the rollers 28, and is positioned so that the axis of the occlusion bed surface is coincident with the axis of the rotor assembly. Flexible hollow tubing (not shown) is positioned between the occlusion bed 30 and the rollers 28. When the rotor is turned, pressure applied by each roller 28 to the tubing (not shown) provides a squeezing action between the roller 28 and the occlusion bed 30, creating increased pressure ahead of the squeezed area and reduced pressure behind that area, thereby forcing a liquid through the tubing.

Figure 3:
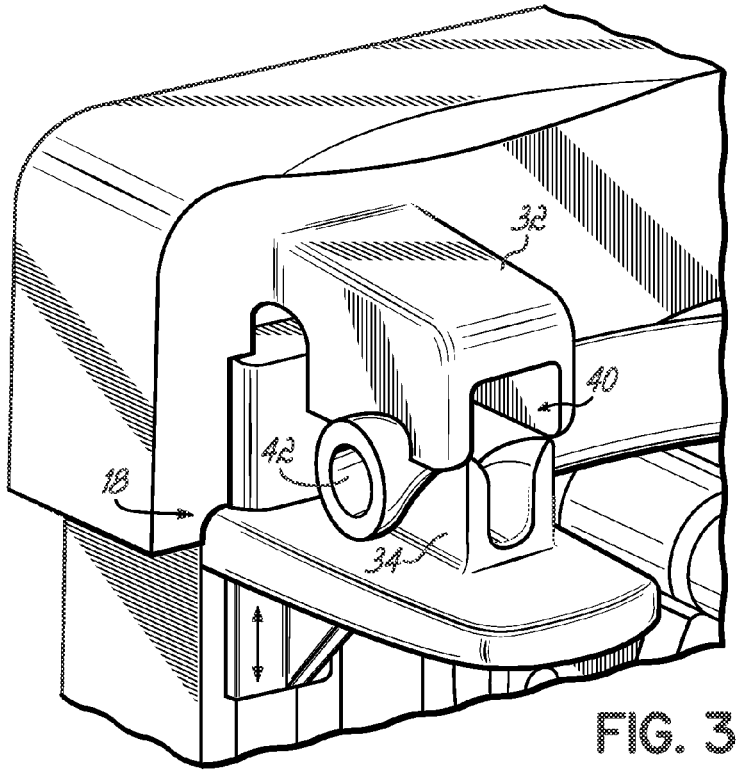
FIG. 3 is a perspective view showing more detail of the tube retainer system shown in FIG. 2.

Each of the two tube retainer systems 18 primarily comprises a base 32 protruding from the body 22 of the pump 16 and a retainer 34 as shown in more detail in FIG. 3. The retainer 34 is slidably translatable toward the base 32. In this embodiment, coil spring compression may be utilized to drive the retainer 34 towards the base 32, although any means of mechanical motivation would be applicable. The walls 36, 38 of the retainer 34 are received in a channel 40 in the base 32 when no tubing is inserted in the pump, though in other embodiments, any means to capture and guide the retainers would be applicable. When tubing 42 is inserted into the retainer system, the tubing 42 contacts the generally planar surfaces of the base 32 and contacts the top surfaces 44, 46 of the notches 48, 50 in the retainer 34. The coil spring used to drive the retainer 34 toward the base 32 applies a spring force sufficient to hold the retainer 34 against the tubing 42 to prevent the tubing from slipping and without significant distortion.

Figure 4:
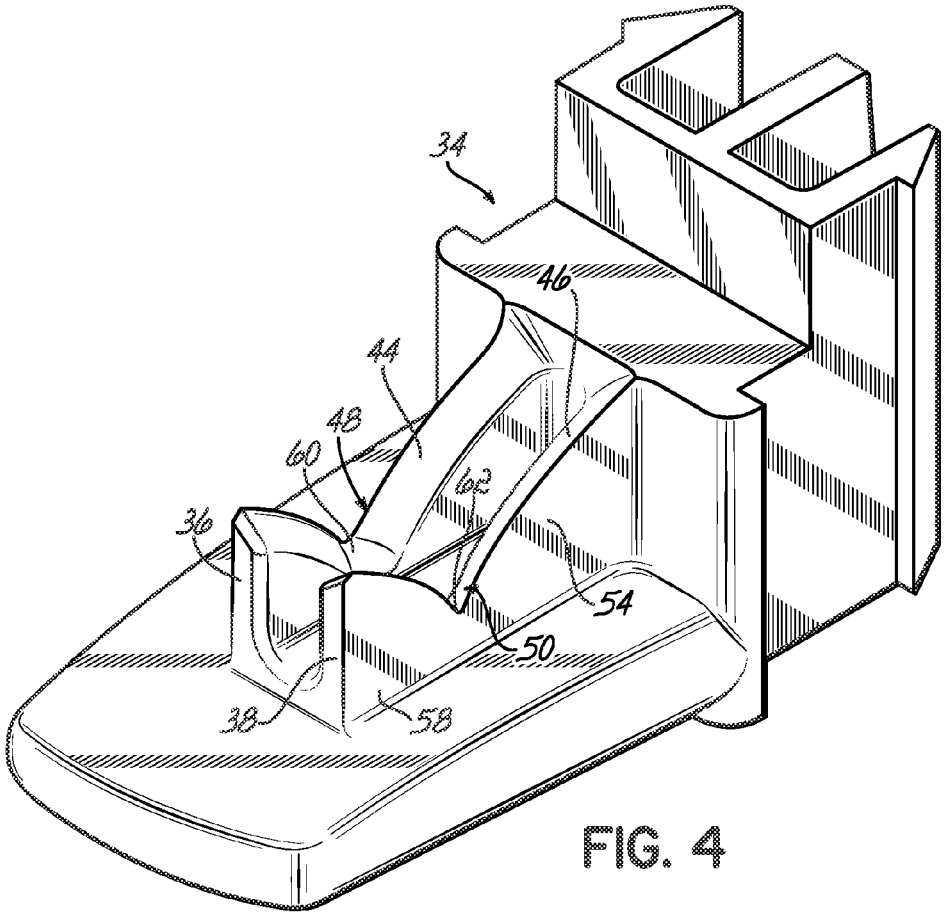
FIG. 4 is a perspective view of a retainer clip used in the tube retainer system of FIG. 2.
Figure 5:
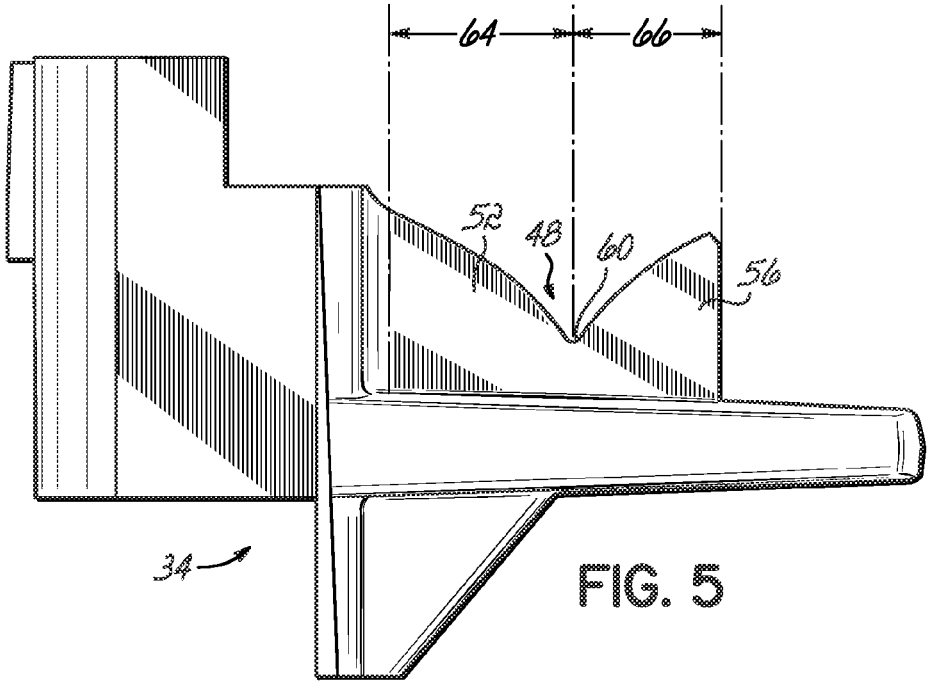
FIG. 5 is a side elevational view of the retainer clip shown in FIG. 4.
Figure 6:
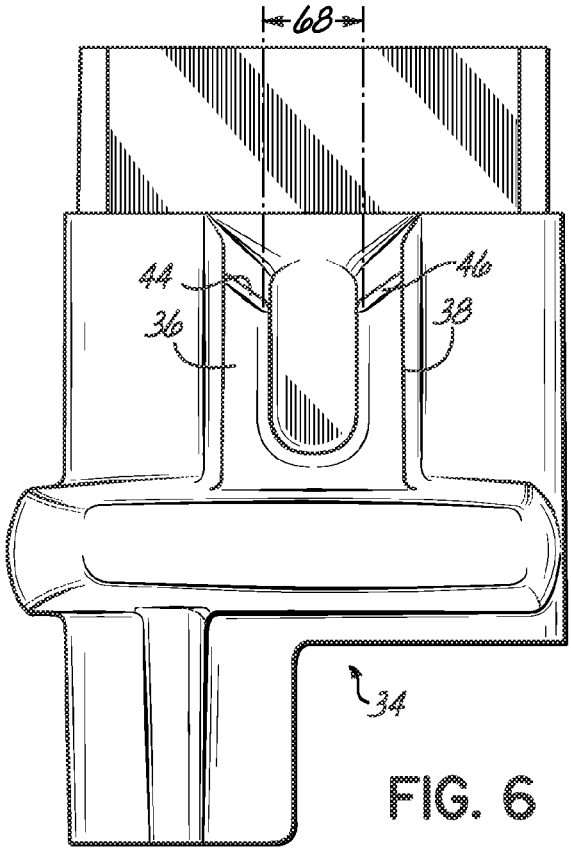
FIG. 6 is an elevational end view of the retainer clip shown FIG. 4.

Referring now to FIGS. 4 through 6, the retainer 34 comprises a non-linear taper that allows for the gripping of generally small to generally large outer diameter tubing without slippage or distortion. An exemplary retainer 34 comprises a pair of walls 36,38, each containing a notch 48, 50. In other embodiments, the retainer may be comprised of a single wall. Each wall is composed of a first arcuate portion 52, 54 and a second arcuate portion 56, 58 which converge at a juncture 60, 62 forming the notch 48, 50. The first 52, 54 and second 56, 58 arcuate portions may be convex and the junctures 60, 62 may be arcuate. The multiple walls in this embodiment provide for the clamping forces to be shared by the two notches 48, 50 resulting in less deformation in high aspect ratio tubing. In some embodiments, the top surfaces of the walls 44, 46 may be inclined toward each other as a means of concentrating the clamping force to assist with the retention of tubing consisting of harder materials.

The first arcuate portion 52 forming the notch 48 in the wall 36 has a length 64 which may be greater than the length 66 of the second arcuate portion 56 forming the notch 48 in the wall 36. Similarly, the length of the first arcuate portion 54 forming the notch 50 in the wall 38 may be greater than the length of the second arcuate portion 58 forming the notch 50 in the wall 38. In the present embodiment the two walls 36, 38 are separated by a distance 68. The separation may provide additional retention help by means of adding an offset to the tubing path. The distance 68 may be varied to adjust the amount of offset.

The nonlinear shape of the notches 48, 50 may provide a number of advantageous characteristics for embodiments required to handle a multitude of tubing sizes. The nonlinear shape may accommodate a larger variation in tubing diameters while requiring less retainer travel than a retainer with a v-shape notch. As a result, the clamping force provided by the retainer's spring or springs varies less as the tubing sizes change. The variation in the clamping forces is proportional to the change in tubing sizes as the spring force providing the clamping is a function of the amount of spring deflection, i.e. the larger the tubing, the more deflection. When tubing is subjected to the clamping forces provided by the retainers, it is deformed in such a way that may result in a restriction of flow in the tubing. The nonlinear shape provides a means for tuning the point of tangency of the retainer's arc and the outer diameter of the tube, minimizing the restriction. The compressed tube's configuration may be altered by changing the retainer's arc size and spring character. The nonlinear shape may also be an advantage when working with tubing of different material hardness. These points would apply as well to embodiments with retainers that would not have to accommodate different tubing sizes.

Referring now to FIGS. 2-4, tubing 42 is loaded into the pump 16 by opening the front cover 20 and depressing the occlusion bed locking tabs 70 to move the occlusion bed 30 to an open position. One retainer 34 is depressed, sliding it away from the base 32 to an open position to allow insertion of tubing 42. While holding the retainer 34 open, tubing 42 is placed on the retainer 34 and the spring force acting on the retainer 34 returns it to its closed position. With the tubing 42 captured in the first retainer 34, the tubing 42 is then wrapped around the occlusion bed 30. The second retainer 34 is depressed, sliding it away from the base 32 to an open position and tubing 42 is placed on the retainer 34. The second retainer 34 is returned to its closed position via the spring force acting on the retainer 34. The occlusion bed 30 is returned to its closed position and the pump cover 20 is closed. The pump 16 would now be ready to move fluid through the tubing.

While the present invention has been illustrated by a description of various embodiments and while these embodiments have been described in considerable detail, it is not the intention of the applicant to restrict or in any way limit the scope of the appended claims to such detail. For example, while embodiments for peristaltic pumps are illustrated and described herein, the tube retainer system of the present invention may be utilized in other systems or applications that require holding flexible tubing in place without slippage and distortion. In addition, other advantages and modifications will be readily apparent to those skilled in the art. The invention in its broader aspects is therefore not limited to the specific details, representative apparatus and method, and illustrative examples shown and described. Accordingly, departures may be made from such details without departing from the spirit or scope of Applicants' general inventive concept.

What is claimed is:

1. A peristaltic pump comprising:

a housing;

a rotor assembly supported by the housing; and a tube retainer for retaining a fluid carrying tube in the peristaltic pump, the tube retainer comprising:

a first wall; and a first notch in the first wall having an arcuate first portion and an arcuate second portion that converge at a juncture, each of the arcuate first and second portions diverging along a respective entire length thereof in a direction extending away from the juncture;

wherein both of the arcuate first and second portions of the first notch are convex; and further wherein the arcuate first and second portions are configured to engage and retain the fluid carrying tube within the first notch so as, in use, to prevent slippage of the fluid carrying tube relative to the first notch.

2. The peristaltic pump of claim 1, wherein the juncture is arcuate.

3. The peristaltic pump of claim 1, wherein the arcuate first portion has a length and the arcuate second portion has a length, and further wherein the length of the arcuate first portion is greater than the length of the arcuate second portion.

4. The peristaltic pump of claim 1, wherein the tube retainer further comprises:

a second wall; and a second notch in the second wall having an arcuate first portion and an arcuate second portion that converge at a juncture, each of the arcuate first and second portions of the second notch diverging along a respective entire length thereof in a direction extending away from the juncture;

wherein both of the arcuate first and second portions of the second notch are convex, and further wherein the arcuate first and second portions of the second notch are configured to engage and retain the fluid carrying tube within the second notch so as, in use, to prevent slippage of the fluid carrying tube relative to the second notch.

5. The peristaltic pump of claim 4, wherein the arcuate first and second portions of the second notch correspond to the arcuate first and second portions of the first notch.

6. The peristaltic pump of claim 4, wherein the first wall has a top surface and the second wall has a top surface, and further wherein the top surface of the first wall and the top surface of the second wall are inclined toward each other.

7. The peristaltic pump of claim 4, wherein the first wall and second wall are separated by a distance.

8. A peristaltic pump comprising:

a housing;

a rotor assembly supported by the housing; and a tube retaining system for retaining a fluid carrying tube in the peristaltic pump, the tube retaining system comprising:

a base having a tube engaging surface; and a retainer comprising:

a wall; and a notch in the wall having an arcuate first portion and an arcuate second portion that converge at a juncture, each of the arcuate first and second portions diverging along a respective entire length thereof in a direction extending away from the juncture;

wherein the arcuate first and second portions of the notch are oriented toward the base and both of the arcuate first and second portions are convex, the arcuate first and second portions being configured to engage and retain the fluid carrying tube within the notch so as, in use, to prevent slippage of the fluid carrying tube relative to the notch; and wherein the retainer is slideably translatable from a first open position to a second closed position with the base.

9. The peristaltic pump of claim 8 wherein the retainer is spring biased toward the second closed position with the base.

10. The peristaltic pump of claim 8 wherein the arcuate first portion of the notch has a length and the arcuate second portion of the notch has a length, and further wherein the length of the arcuate first portion is greater than the length of the arcuate second portion.

11. The peristaltic pump of claim 8 wherein the juncture of the notch in the wall of the retainer is arcuate.

12. The peristaltic pump of claim 8 wherein the base further comprises:

a first wall having a first tube engaging surface; and a second wall having a second tube engaging surface;

wherein the first wall and second walls are separated by a distance forming a channel;

wherein the channel is sufficient to receive the wall of the retainer; and wherein the first and second tube engaging surfaces are oriented towards the retainer.

13. The peristaltic pump of claim 8 further comprising:

flexible tubing;

wherein the flexible tubing is positioned between the base and the retainer; and wherein the flexible tubing contacts the tube engaging surface of the base and the arcuate first and second portions of the notch.

14. A peristaltic pump comprising:

a housing;

a rotor assembly supported by the housing; and a first supported by the housing and comprising:

a first base having a tube engaging surface; and a first retainer comprising:

a first wall; and a first notch in the first wall having an arcuate first portion and an arcuate second portion that converge at a juncture, each of the arcuate first and second portions diverging along a respective entire length thereof in a direction extending away from the juncture;

wherein the arcuate first and second portions of the first notch are oriented toward the first base and at least one of the arcuate first and second portions of the first notch is convex, the arcuate first and second portions of the first notch being configured to engage and retain a fluid carrying tube within the first notch; and wherein the first retainer is slideably translatable from a first open position to a second closed position with the first base.

15. The peristaltic pump of claim 14 further comprising:

a second supported by the housing and comprising:

a second base having a tube engaging surface; and a second retainer comprising:

a second wall; and a second notch in the second wall having an arcuate first portion and an arcuate second portion that converge at a juncture, each of the arcuate first and second portions diverging along a respective entire length thereof in a direction extending away from the juncture;

wherein the arcuate first and second portions of the second notch are oriented toward the second base and at least one of the arcuate first and second portions of the second notch is convex, the arcuate first and second portions of the second notch being configured to engage and retain the fluid carrying tube within the second notch; and wherein the second retainer is slideably translatable from a first open position to a second closed position with the second base.

16. The peristaltic pump of claim 15 wherein the first tube retaining system is aligned with the second and separated therefrom by a distance.

17. The peristaltic pump of claim 16 wherein the first retainer of the first and the second retainer of the second are slideably translatable toward each other.

18. The peristaltic pump of claim 14 wherein the arcuate first and second portions of the first notch are both convex.

19. The peristaltic pump of claim 15 wherein the arcuate first and second portions of the second notch are both convex.

* * * * *

UNITED STATES PATENT AND TRADEMARK OFFICE

CERTIFICATE OF CORRECTION

PATENT NO. : 7,980,835 B2
APPLICATION NO. : 11/624852
DATED : July 19, 2011
INVENTOR(S) : Sam LaBanco et al.

It is certified that error appears in the above-identified patent and that said Letters Patent is hereby corrected as shown below:

In column 2, line 35, change "elimination of specialty tubing required for retention purposed;" to --elimination of specialty tubing required for retention purposes;--.

In column 2, lines 60-61, change "FIG. 6 is an elevational end view of the retainer clip shown FIG. 4." to --FIG. 6 is an elevational end view of the retainer clip shown in FIG. 4.--.

In column 4, line 46, change "it is not the intention of the applicant" to --it is not the intention of the applicants--.

In claim 12, column 6, line 17, change "wherein the first wall and second walls" to --wherein the first wall and second wall--.

In claim 14, column 6, line 33, change "a first supported by the housing and comprising:" to --a first tube retaining system supported by the housing and comprising:--.

In claim 15, column 6, line 54, change "a second supported by the housing and comprising:" to --a second tube retaining system supported by the housing and comprising:--.

In claim 16, column 7, line 8, change "is aligned with the second" to --is aligned with the second tube retaining system--.

In claim 17, column 8, line 2, change "wherein the first retainer of the first and the second retainer of the second are" to --wherein the first retainer of the first tube retaining system and the second retainer of the second tube retaining system are--.

Signed and Sealed this
Thirtieth Day of August, 2011

David J. Kappos

David J. Kappos
*Director of the United States Patent and Trademark Office*